US005483704A

United States Patent [19]

Filipiak

[11] Patent Number: 5,483,704

[45] Date of Patent: Jan. 16, 1996

[54] CLIP-ON GARTER

[76] Inventor: Edmund C. Filipiak, 143 County Rd. 135, Barnum, Minn. 55707

[21] Appl. No.: 231,835

[22] Filed: Apr. 25, 1994

[51] Int. Cl.[6] ..... A41F 1/00

[52] U.S. Cl. ..... 2/336; 2/337; 2/239; 24/306; 24/72.1

[58] Field of Search ..... 2/336, 337, 239; 24/306, 72; 224/148

[56] References Cited

U.S. PATENT DOCUMENTS

| | | | |
|---|---|---|---|
| 1,046,798 | 12/1912 | Jones | 2/337 |
| 2,079,045 | 5/1937 | Schlaepfer | 2/337 |
| 3,298,036 | 1/1967 | Chalfin | 2/337 |
| 3,423,764 | 1/1969 | Cassling | 2/337 |
| 5,379,491 | 1/1995 | Solo | 24/306 |
| 5,381,922 | 1/1995 | Gladman et al. | 224/148 |

*Primary Examiner*—C. D. Crowder
*Assistant Examiner*—Gloria Hale

[57] ABSTRACT

Disclosed is a clip-on garter for retaining a sock fully upright while being worn within a boot whereby preventing sliding of the sock into the boot cavity caused by movement of a user's foot relative the boot. The clip-on garter comprises a boot clip member clampedly attachable to the boot at the top edge of the leg opening. The boot clip member is formed of an elongated strip of resilient plastic or metal folded back against itself to form an inverted U-shaped structure having generally parallel inside and outside tension arms. The two arm ends define a clamping zone therebetween wherebetween the edge of the boot opening may be retained. A strip of pile fabric material is disposed on the inside arm such that the sock fabric engages with the pile fabric material whereby the top edge of the sock is retained adjacent the top edge of the boot leg opening for preventing the sock from sliding down into the boot cavity.

4 Claims, 4 Drawing Sheets

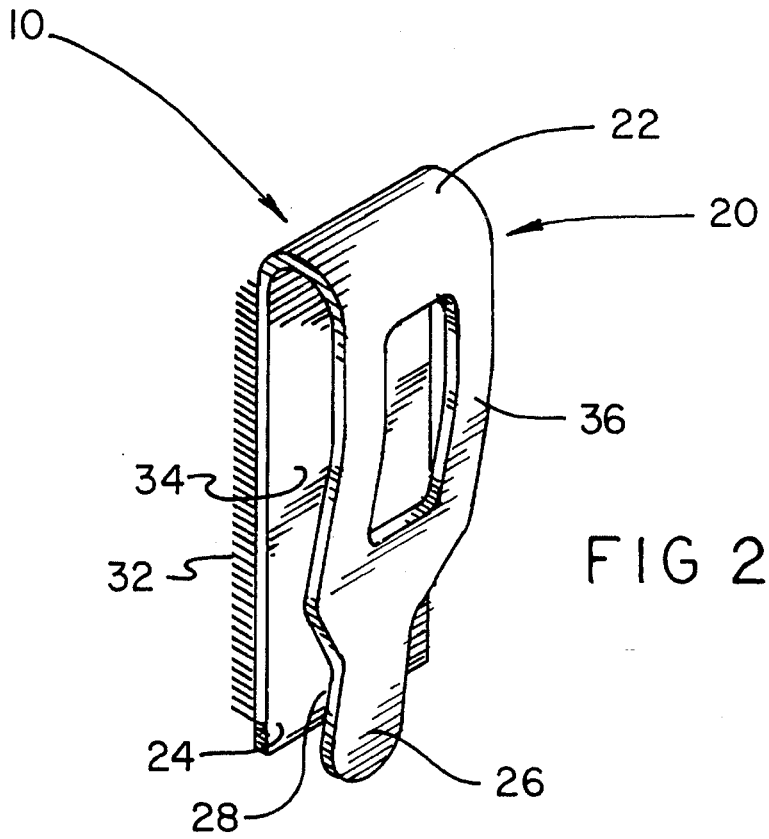
FIG 2
FIG 3
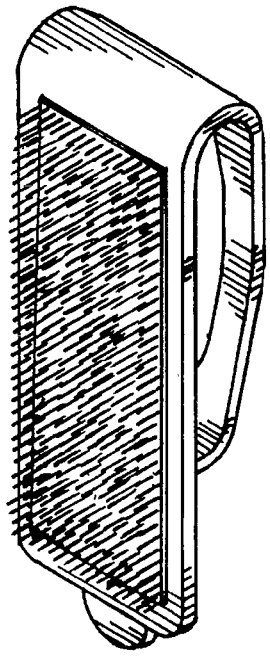

CLIP-ON GARTER

BACKGROUND OF THE INVENTION

1. Field of the Invention

The present invention relates to garters and more particularly pertains to a clip-on garter which may be adapted for retaining a sock fully upright while being worn within a boot whereby preventing sliding of the sock into the boot cavity caused by movement of a user's foot relative the boot.

2. Description of the Prior Art

The use of garters is known in the prior art. More specifically, garters heretofore devised and utilized for the purpose of preventing downward movement of a sock or stocking on the leg of a wearer are known to consist basically of familiar, expected and obvious structural configurations, notwithstanding the myriad of designs encompassed by the crowded prior art which have been developed for the fulfillment of countless objectives and requirements.

The present invention is directed to improving devices for preventing downward movement of a sock or stocking on the leg of a wearer in a manner which is safe, secure, economical and aesthetically pleasing.

Related prior art U.S. Pat. Nos. 4,055,858 and 4,106,126, both to Traenkle, describe within-the-shoe socks having removable retaining devices comprised of an enlarged member, which may be in the form of a pompon, and a relatively narrow supporting member, which may be in the form of a ribbon, is connected to the enlarged member. The enlarged member is adapted to be disposed outside the shoe and in engagement therewith to prevent downward movement of the sock. Other relevant prior art devices are a sock and shoe and sock and shoe fastening means of U.S. Pat. No. 4,169,324 and a strap fastening means for a sock and shoe combination of U.S. Pat. No. 4,187,619, both to Gibbs. All the inventions disclosed above require permanent modification to the shoe and/or the sock which tends to increase cost and reduce versatility. Furthermore, the enlarged member disposed outside the shoe as shown in the Traenkle patents is in a position to be a potential safety hazard by being easily snagged by surrounding objects.

The prior art also discloses hook-and-pile strips for socks and the like as shown in U.S. Pat. No. 4,165,555 to Boxer et al. While this device fulfills its particular objectives and requirements, the aforementioned patent does not disclose a clip-on garter for retaining a sock fully upright while being worn within a boot.

In this respect, the clip-on garter according to the present invention substantially departs from the conventional concepts and designs of the prior art, and in so doing provides an apparatus primarily developed for the purpose of retaining a sock fully upright while being worn within a boot whereby preventing sliding of the sock into the boot cavity caused by movement of a user's foot relative the boot.

Therefore, it can be appreciated that there exists a continuing need for a new clip-on garter which can be used for retaining a sock fully upright while being worn within a boot whereby preventing sliding of the sock into the boot cavity caused by movement of a user's foot relative the boot. In this regard, the present invention substantially fulfills this need.

As illustrated by the background art, efforts are continuously being made in an attempt to develop devices for preventing downward movement of a sock or stocking on the leg of a wearer. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of garters now present in the prior art, the present invention provides a new garter construction wherein the same can be utilized for retaining a sock fully upright while being worn within a boot whereby preventing sliding of the sock into the boot cavity caused by movement of a user's foot relative the boot. As such, the general purpose of the present invention, which will be described subsequently in greater detail, is to provide a new clip-on garter apparatus and method which has all the advantages of the prior art garters and none of the disadvantages.

The invention is defined by the appended claims with the specific embodiment shown in the attached drawings. For the purpose of summarizing the invention, the invention may be incorporated into a clip-on garter for retaining a sock fully upright while being worn within a boot. The clip-on garter comprises a boot clip member clampedly attachable to the boot at the top edge of the leg opening thereof. The boot clip member is formed of an elongated strip of resilient plastic or metal folded back against itself intermediate the ends thereof to form an inverted U-shaped structure having generally parallel inside and outside tension arms thereon. The outside arm is further formed such that a portion of the end thereof lies in generally parallel touching relationship with the end of the inside arm. The two arm ends define a clamping zone therebetween wherebetween the edge of the boot opening may be retained such that the inside arm extends into the boot opening in touching facing relationship with the user's sock. The boot clip member additionally has a strip of pile fabric material disposed on the surface thereof touching the sock such that the sock fabric engages with the pile fabric material whereby the top edge of the sock is retained adjacent the top edge of the boot leg opening whereby preventing the sock from sliding down into the boot cavity.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a clip-on garter for retaining a sock fully upright while being worn within a boot whereby preventing sliding of the sock into the boot cavity.

It is another object of the present invention to provide a new clip-on garter which may be easily and efficiently manufactured and marketed.

It is a further object of the present invention to provide a new clip-on garter which is of a durable and reliable construction.

An even further object of the present invention is to provide a new clip-on garter which is susceptible of a low cost of manufacture with regard to both materials and labor, and which accordingly is then susceptible of low prices of sale to the consuming public, thereby making such clip-on garters economically available to the buying public.

Still yet another object of the present invention is to provide a new clip-on garter which provides in the apparatuses and methods of the prior art some of the advantages thereof, while simultaneously overcoming some of the disadvantages normally associated therewith.

Still yet another object of the present invention is to provide a clip-on garter especially useful to hunters, woodsmen, and other outdoors enthusiasts and workers who wear boots with socks while engaging in strenuous activity for extended periods of time.

Yet another object of the present invention is to provide a clip-on garter that is adapted to work with a wide variety of different boot and a sock combinations without requiring modification to the garter, the boot, or the sock.

Even still another object of the present invention is to provide a clip-on garter that does not require permanent attachment to the boot or sock thereby reducing cost and increasing the versatility of the device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a top outside perspective view of the present invention.

FIG. 3 is a top inside perspective view of the present invention.

DESCRIPTION OF THE PREFERRED EMBODIMENT

Figure 1:
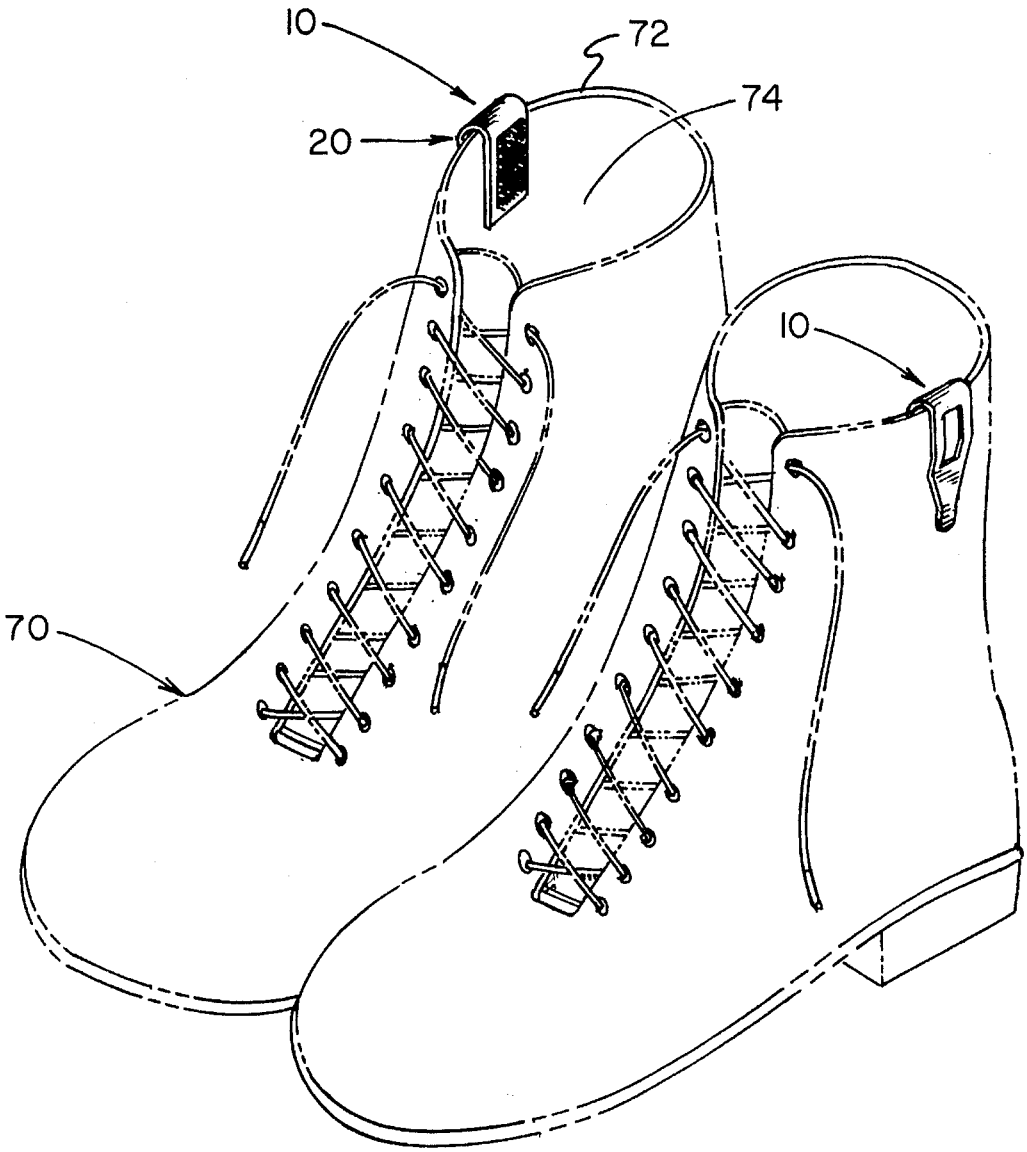
FIG. 1 is a top perspective view of a pair of clip-on garters showing their manner of use with a pair of boots.
Figure 4:
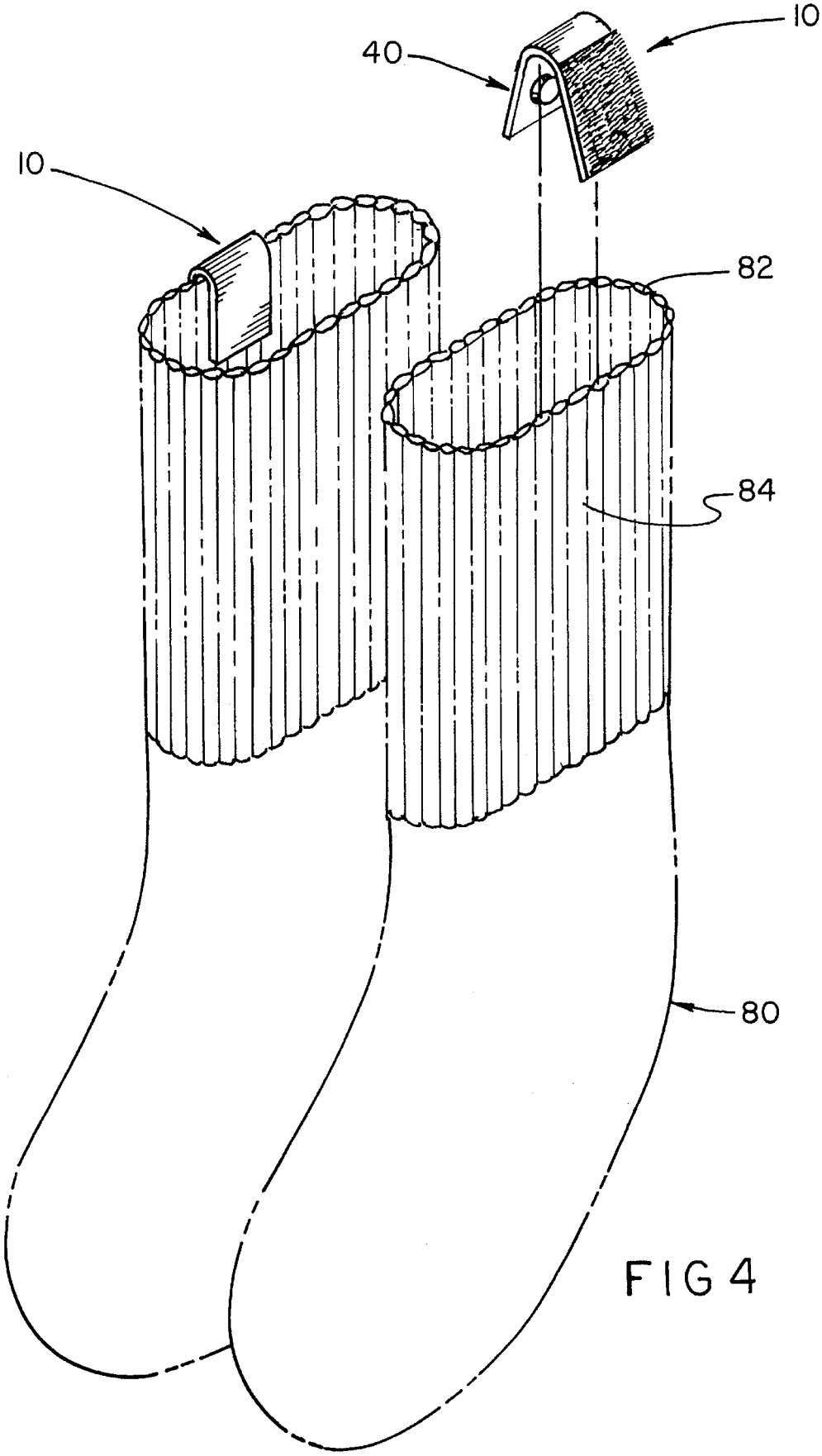
FIG. 4 is a top perspective view of a pair of sock clip members of the preferred embodiment of the clip-on garter showing their manner of use.
Figure 5:
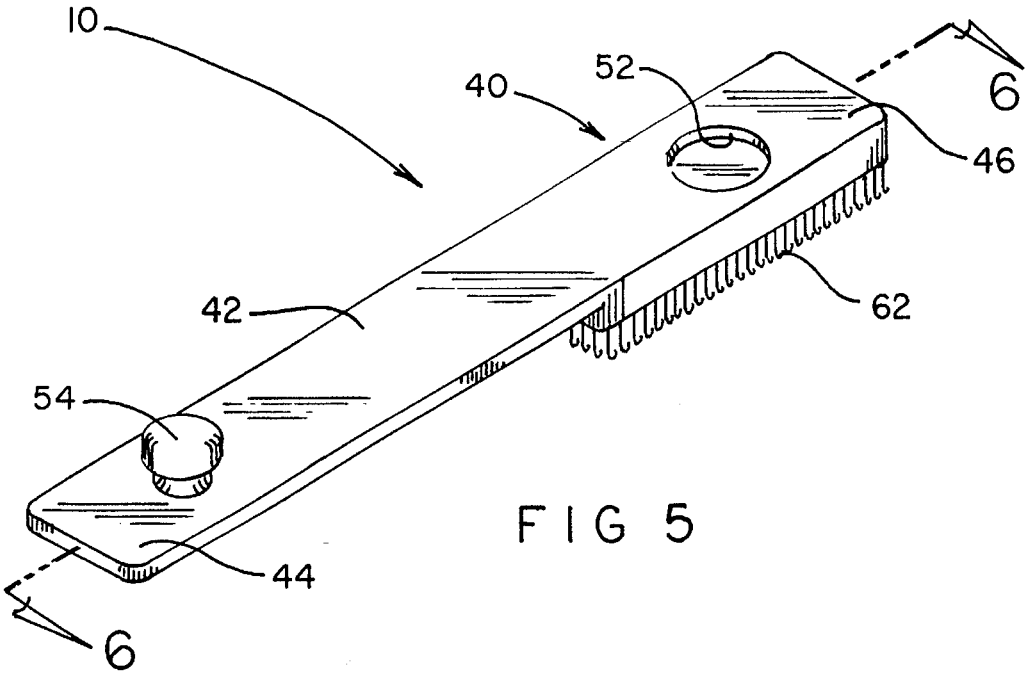
FIG. 5 is a bottom perspective view of a sock clip of the present invention shown in the unfolded position.
Figure 6:
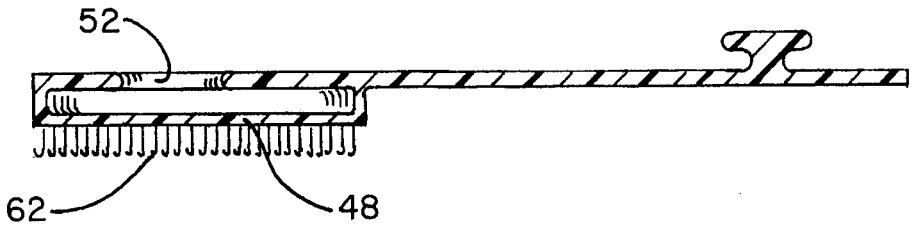
FIG. 6 is a sectional view of the invention of FIG. 5 taken along the line 6—6.

With reference now to the drawings, and in particular to FIG. 1 thereof, a clip-on garter embodying the principles and concepts of the present invention and generally designated by the reference numeral 10 will be described.

From an overview standpoint, the clip-on garter is adapted for use for retaining a sock fully upright while being worn within a boot whereby preventing sliding of the sock into the boot cavity caused by movement of a user's foot relative the boot. See FIG. 1.

With reference now to FIGS. 1–6 and more specifically, it will be noted that a clip-on garter 10 is shown. The clip-on garter 10 comprises a boot clip member 20 clampedly attachable to the boot 70 at the top edge of the leg opening 72 thereof. The boot clip member 20 is formed of an elongated strip 22 of resilient plastic or metal folded back against itself intermediate, pair of arm ends 24 and 26 thereof to form an inverted U-shaped structure having generally parallel inside and outside tension arms 34 and 36. The pair of arm ends form a first arm end 24 and a second arm end 26. The outside arm 36 is further formed such that a portion of the end 26 thereof lies in generally parallel touching relationship with the end 24 of the inside arm 34. The two arm ends 24 and 26 define a clamping zone 28 therebetween wherebetween the edge of the boot opening 72 may be retained such that the inside arm 34 extends into the boot opening in touching facing relationship with the user's sock 80. The boot clip member 20 additionally has a strip of pile fabric material 32 disposed on the surface of the inside arm 34 touching the sock 80.

A sock clip member 40 is snapidly attachable to the sock 80 at the top edge of the leg opening 82 thereof. The sock clip member 40 is formed of an elongated strip 42 of flexible material having an integrally formed two-part snap fastener 52 and 54 thereon. The snap fastener 52 and 54 comprises a male member 54 projecting from a side of the flexible strip 42 proximal a first end 44 thereof and a female socket 52 extending into the side of the flexible strip 42 proximal a second end 46 thereof. The flexible strip 42 is foldable laterally intermediate the ends 44 and 46 thereof over the edge of the sock leg opening 82 such that a portion of the flexible strip 42 having the male member 54 lies inside the sock leg opening 82 and a portion of the flexible strip 42 having the female socket 52 lies outside the sock 80.

The male member 54 is snapidly engageable with the female socket 52 while simultaneously trapping a portion of sock fabric 84 therebetween to secure the sock clip 40 to the sock 80. The reverse side or boot-adjacent surface 48 of the socket portion lies adjacent the inside of the boot opening 72 in touching facing relationship with the strip of pile fabric material 32 of the boot clip member 20. The sock clip member 40 additionally has a strip of pile fabric engageable hook material 62 disposed on the boot-adjacent surface 48 thereof. The hook material 62 is engageable with the pile material 32 of the boot clip member 20 such that the top edge of the sock opening 82 is retained adjacent the top edge of the boot leg opening 72 whereby preventing the sock 80 from sliding down into the boot cavity 74.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A clip-on garter for retaining a sock fully upright while being worn within a boot whereby preventing sliding of the sock into the boot cavity caused by movement of a user's foot relative the boot, the clip-on garter comprising:

a boot clip member clampedly attachable to the boot at the top edge of the leg opening thereof, the boot clip member being formed of an elongated strip of resilient material folded back against itself intermediate a pair of arm ends thereof to form an inverted U-shaped structure having generally parallel inside and outside tension arms thereon, the pair of arm ends forming a first arm end and a second arm end, the outside arm being further formed such that the second arm end thereof lies in generally parallel touching relationship with the first arm end of the inside arm, the two arm ends defining a clamping zone therebetween wherebetween the edge of the boot opening may be retained such that the inside arm extends into the boot opening in touching facing relationship with the user's sock, the boot clip member additionally having a strip of pile fabric material disposed on the surface thereof; and a sock clip member snapidly attachable to the sock at the top edge of the leg opening thereof, the sock clip member being formed of an elongated strip of flexible material having an integrally formed two-part snap fastener thereon, the snap fastener comprising a male member projecting from a side of the flexible strip proximal a first end thereof and a female socket extending into the side of the flexible strip proximal a second end thereof, the flexible strip being foldable laterally intermediate the first and second end thereof over the edge of the sock leg opening such that a portion of the flexible strip having the male member lies inside the sock leg opening and a portion of the flexible strip having the female socket lies outside the sock, the male member being snapidly engageable with the female socket while simultaneously trapping a portion of sock fabric therebetween to secure the sock clip to the sock, the reverse side of the socket portion lying adjacent the inside of the boot opening in touching facing relationship with the strip of pile material of the boot clip member, the sock clip member additionally having a strip of pile fabric engageable hook material disposed on the boot-adjacent surface thereof, the hook material being engageable with the pile material of the boot clip member such that the top edge of the sock is retained adjacent the top edge of the boot leg opening whereby preventing the sock from sliding down into the boot cavity.

2. A clip-on garter for retaining a sock fully upright while being worn within a boot whereby preventing sliding of the sock into the boot cavity caused by movement of a user's foot relative the boot, the clip-on garter comprising:

a boot clip member clampedly attachable to the boot at the top edge of the leg opening thereof such that a portion thereof extends inside the boot opening in facing engageable relationship with the user's sock;

a sock clip member snapidly attachable to the sock at the top edge of the leg opening thereof such that a portion thereof lies outside the sock in facing engageable relationship with the portion of the boot clip member inside the boot whereby the top edge of the sock is retained adjacent the top edge of the boot leg opening for preventing the sock from sliding down into the boot cavity.

3. The clip on garter of claim 2 wherein the boot clip member comprises an elongated strip of resilient material folded back against itself intermediate a pair of arm ends to form an inverted U-shaped structure having generally parallel inside and outside tension arms thereon, the pair of arm ends form a first arm end and a second arm end, the outside arm being further formed such that the second arm end thereof lies in generally parallel touching relationship with the first arm end of the inside arm, the two arm ends defining a clamping zone therebetween wherebetween the edge of the boot opening may be retained such that the inside arm extends into the boot opening in touching facing relationship with the user's sock; and a strip of pile fabric material disposed on the surface touching the sock for engagement therewith.

4. The clip-on garter of claim 3 wherein the sock clip member comprises an elongated strip of flexible material having an integrally formed two-part snap fastener thereon, the snap fastener comprising a male member projecting from a side of the flexible strip proximal a first end thereof and a female socket extending into the side of the flexible strip proximal a second end thereof, the flexible strip being foldable laterally intermediate the ends thereof over the edge of the sock leg opening such that a portion of the flexible strip having the male member lies inside the sock leg opening and a portion of the flexible strip having the female socket lies outside the sock, the male member being snapidly engageable with the female socket while simultaneously trapping a portion of sock fabric therebetween to secure the sock clip to the sock, the reverse side of the socket portion lying adjacent the inside of the boot opening in touching facing relationship with the strip of pile material of the first clip member; and a strip of pile fabric engageable hook material disposed on the boot-adjacent surface, the hook material being engageable with the pile material of the first clip member.

* * * * *